US009243648B2

(12) United States Patent
Clemons et al.

(10) Patent No.: US 9,243,648 B2
(45) Date of Patent: Jan. 26, 2016

(54) REMOVABLE THROAT MOUNTED INLET GUIDE VANE

(75) Inventors: Jonathan D. Clemons, Lakeview, NY (US); Mark R. Sabin, Sanborn, NY (US); Thomas E. Gerber, Williamsville, NY (US)

(73) Assignee: Ingersoll-Rand Company, Davidson, NC (US)

( * ) Notice: Subject to any disclaimer, the term of this patent is extended or adjusted under 35 U.S.C. 154(b) by 669 days.

(21) Appl. No.: 13/386,027

(22) PCT Filed: Jul. 19, 2010

(86) PCT No.: PCT/US2010/042486

§ 371 (c)(1),
(2), (4) Date: Jan. 19, 2012

(87) PCT Pub. No.: WO2011/011338

PCT Pub. Date: Jan. 27, 2011

(65) Prior Publication Data

US 2012/0121403 A1 May 17, 2012

Related U.S. Application Data

(60) Provisional application No. 61/227,032, filed on Jul. 20, 2009.

(51) Int. Cl.
*F01D 17/16* (2006.01)
*F04D 29/42* (2006.01)
(Continued)

(52) U.S. Cl.
CPC ..... *F04D 29/4213* (2013.01); *F01D 17/162* (2013.01); *F04D 27/0246* (2013.01); *F04D 29/462* (2013.01); *F05D 2260/74* (2013.01)

(58) Field of Classification Search
CPC ..... F01D 17/16; F01D 17/162; F04D 27/002; F04D 27/0246; F04D 29/287; F04D 29/46; F04D 29/464; F04D 29/462; F05D 2260/74–2260/76; F02C 9/20; F02C 9/22
USPC ..... 415/160, 162–166, 209.2
See application file for complete search history.

(56) References Cited

U.S. PATENT DOCUMENTS 2,603,538 A 7/1952 Butterfield
2,606,713 A 8/1952 Bauger
(Continued)

FOREIGN PATENT DOCUMENTS

CN 201090533 Y 7/2008
DE 33540 11/1965
(Continued)

OTHER PUBLICATIONS

Communication from European Patent Office application No. 10735152.0, dated Jul. 17, 2012, 2 pages.
(Continued)

*Primary Examiner* — Edward Look
*Assistant Examiner* — Danielle M Christensen
(74) *Attorney, Agent, or Firm* — Taft Stettinius & Hollister, LLP

(57) ABSTRACT

In certain embodiments, a system includes an inlet guide vane assembly. The inlet guide vane assembly includes a plurality of inlet guide vanes disposed in a radial pattern around a central axis and configured to rotate about axes orthogonal to the central axis. The inlet guide vane assembly also includes a plurality of vane shafts, each connected to a respective inlet guide vane and configured to rotate with the respective inlet guide vane about the respective orthogonal axis. The inlet guide vane assembly further includes a drive shaft directly connected to one of the vane shafts and configured to directly cause rotation of the vane shaft to which it is directly connected and to indirectly cause rotation of the remaining vane shafts in the plurality of vane shafts. In addition, the inlet guide vane assembly includes a rotary actuator connected to the drive shaft and configured to cause rotation of the drive shaft.

14 Claims, 13 Drawing Sheets

(51) Int. Cl.

| | |
|---|---|
| ***F04D 27/02*** | (2006.01) |
| ***F04D 29/46*** | (2006.01) |

(56) References Cited

U.S. PATENT DOCUMENTS

| | | | | |
|---|---|---|---|---|
| 2,933,234 | A | 4/1960 | Neumann | |
| 3,089,679 | A | 5/1963 | Henny | |
| 3,362,625 | A * | 1/1968 | Endress | 415/149.1 |
| 3,632,224 | A | 1/1972 | Wright et al. | |
| 3,652,177 | A * | 3/1972 | Loebel | 415/110 |
| 4,050,844 | A | 9/1977 | Miller et al. | |
| 4,609,329 | A | 9/1986 | Pillis et al. | |
| 4,867,636 | A | 9/1989 | Sauron et al. | |
| 5,096,374 | A * | 3/1992 | Sakai et al. | 415/150 |
| 5,388,913 | A | 2/1995 | Cawley et al. | |
| 6,012,897 | A | 1/2000 | Sabnis et al. | |
| 6,039,534 | A | 3/2000 | Stoner et al. | |
| 6,129,511 | A | 10/2000 | Salvage et al. | |
| 6,398,483 | B1 | 6/2002 | Conete et al. | |
| 6,763,578 | B2 | 7/2004 | Farnworth et al. | |
| 7,198,461 | B2 | 4/2007 | Burgmeier et al. | |
| 8,079,808 | B2 | 12/2011 | Sconfietti | |
| 2007/0154302 | A1 * | 7/2007 | Sconfietti | 415/191 |
| 2009/0196745 | A1 | 8/2009 | Sugitani | |
| 2009/0269187 | A1 * | 10/2009 | Jones et al. | 415/159 |
| 2012/0263586 | A1 | 10/2012 | Patil | |

FOREIGN PATENT DOCUMENTS

| | | | |
|---|---|---|---|
| DE | 2203643 | A1 | 8/1973 |
| DE | 10352099 | A1 | 6/2005 |
| EP | 1903187 | A2 | 3/2008 |
| EP | 2053204 | A2 | 4/2009 |
| GB | 1466613 | A | 3/1977 |
| GB | 2402181 | A | 12/2004 |
| GB | 1903187 | A2 | 3/2008 |
| WO | 2007079137 | | 7/2007 |
| WO | 2008124758 | | 10/2008 |

OTHER PUBLICATIONS

Chinese Office Action from Chinese Patent Office application No. 201080041887.9, dated Jan. 6, 2014, 5 pgs.

Communication from the European Patent Office application No. 10735152.0, dated Aug. 6, 2013, 2 pages.

PCT Search Report and Written Opinion for PCT/US2010/042486, mailed on Oct. 19, 2010.

Chinese Second Office Action and Search Report; Application No. CN 201080041887.9; Mailed Aug. 27, 2014; 14 pages.

* cited by examiner

REMOVABLE THROAT MOUNTED INLET GUIDE VANE

CROSS REFERENCE TO RELATED APPLICATION

This application claims priority to U.S. Provisional Patent Application No. 61/227,032, entitled "Removable Throat Mounted Inlet Guide Vane", filed on Jul. 20, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Gas compressors are used in a wide variety of industries including aerospace, automotive, oil and gas, power generation, food and beverage, pharmaceuticals, water treatment, and the like. The compressed gas may include air, nitrogen, oxygen, natural gas, or any other type of gas. Gas compressor systems generally include devices that increase the pressure of a gas by decreasing (e.g., compressing) its volume. Certain types of gas compressors employ one or more mechanisms that employ a rotational torque to compress an incoming gas. For instance, in a centrifugal gas compressor system, a gas is drawn into a housing through an inlet, the gas is compressed by a rotating impeller, and the gas is expelled from the housing. However, quite frequently, these gas compressors occupy a great deal of space. In addition, these gas compressors are often quite complex, thereby making maintenance and servicing more time consuming and expensive.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, centrifugal compressor systems tend to take up a lot of space. As such, there is a continuing need to reduce the amount of space occupied by these systems. However, quite frequently, efforts to reduce the size of centrifugal compressor systems leads to integration of components, which tend to make the systems more complex and, in many instances, decreases the flexibility of both operation and maintenance. The disclosed embodiments address these shortcomings by providing for a certain degree of integration of centrifugal compressor components, while also enabling ease of maintenance by keeping certain components as separable components.

In particular, the disclosed embodiments provide for an inlet guide vane assembly configured to be a separable unit, which may be mounted within a throat of a compressor assembly. As such, the disclosed embodiments may reduce the overall size of each centrifugal compressor stage and reduce the need for external supports. In addition, the disclosed embodiments also facilitate maintenance by making the separate inlet guide vane assembly more easily removable. Also, the disclosed embodiments enable rotary actuation of the inlet guide vanes, as opposed to linear actuation. Doing so may reduce the need for more expensive and more complicated sealing techniques. Instead, the disclosed embodiments provide for a pneumatic cylinder, which fits around the rotating drive shaft, which actuates the inlet guide vanes. The pneumatic cylinder may include an inlet buffer port and an outlet buffer port. A buffer gas may be injected into the inlet buffer port, causing the buffer gas and a process gas leaking along the drive shaft to be expelled through the outlet buffer port. In addition, the disclosed embodiments provide for a circumferential path around an inner housing, which allows for tracking cam followers to minimize axial displacement of an actuating ring with respect to the inner housing.

Figure 1:
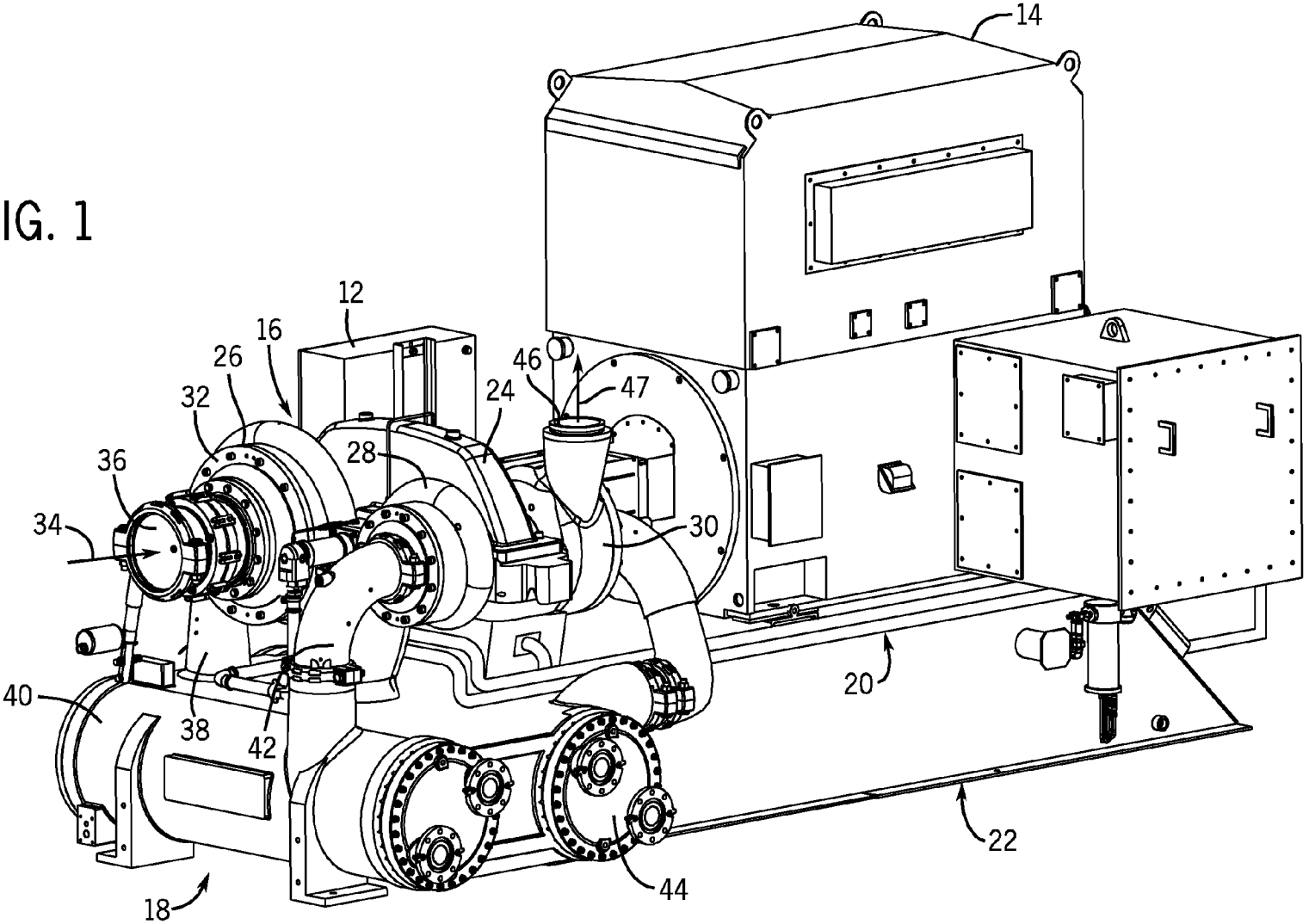
FIG. 1 is a perspective view of an exemplary embodiment of a centrifugal compressor system.

FIG. 1 is a perspective view of an exemplary embodiment of a centrifugal compressor system 10. The centrifugal compressor system 10 is generally configured to compress gas in various applications. For example, the centrifugal compressor system 10 may be employed in applications relating to the automotive industries, electronics industries, aerospace industries, oil and gas industries, power generation industries, petrochemical industries, and the like. In addition, the centrifugal compressor system 10 may be employed to compress gases, which contain certain corrosive elements. For example, the gases may contain carbonic acid, sulfuric acid, carbon dioxide, and so forth.

In general, the centrifugal compressor system 10 includes one or more centrifugal compressor stages configured to increase the pressure of (e.g., compress) incoming gas. In some embodiments, the centrifugal compressor system 10 includes a power rating of approximately 150 to approximately 3,000 horsepower (hp), discharge pressures of approximately 80 to 150 pounds per square inch (psig) and an output capacity of approximately 600 to 15,000 cubic feet per minute (cfm). Although the illustrated embodiment includes only one of many compressor arrangements, other embodiments of the centrifugal compressor system 10 may include various compressor arrangements and operational parameters. For example, the centrifugal compressor system 10 may include a lower horsepower rating suitable for applications having a lower output capacity and/or lower pressure differentials, a higher horsepower rating suitable for applications having a higher output capacity and/or higher pressure differentials, and so forth.

In the illustrated embodiment, the centrifugal compressor system 10 includes a control panel 12, a drive unit 14, a compressor unit 16, an intercooler 18, a lubrication system 20, and a common base 22. The common base 22 generally provides for simplified assembly and installation of the centrifugal compressor system 10. For example, the control panel 12, the drive unit 14, the compressor unit 16, intercooler 18, and the lubrication system 20 are coupled to the common base 22. This enables installation and assembly of the centrifugal compressor system 10 as modular components that are preassembled and/or assembled on site.

The control panel 12 includes various devices and controls configured to monitor and regulate operation of the centrifugal compressor system 10. For example, in one embodiment, the control panel 12 includes a switch to control system power, and/or numerous devices (e.g., liquid crystal displays and/or light emitting diodes) indicative of operating parameters of the centrifugal compressor system 10. In other embodiments, the control panel 12 includes advanced functionality, such as a programmable logic controller (PLC) or the like.

The drive unit 14 generally includes a device configured to provide motive power to the centrifugal compressor system 10. The drive unit 14 is employed to provide energy, typically in the form of a rotating drive unit shaft, which is used to compress the incoming gas. Generally, the rotating drive unit shaft is coupled to the inner workings of the compressor unit 16, and rotation of the drive unit shaft is translated into rotation of an impeller that compresses the incoming gas. In the illustrated embodiment, the drive unit 14 includes an electric motor that is configured to provide rotational torque to the drive unit shaft. In other embodiments, the drive unit 14 may include other motive devices, such as a compression ignition (e.g., diesel) engine, a spark ignition (e.g., internal gas combustion) engine, a gas turbine engine, or the like.

The compressor unit 16 typically includes a gearbox 24 that is coupled to the drive unit shaft. The gearbox 24 generally includes various mechanisms that are employed to distribute the motive power from the drive unit 14 (e.g., rotation of the drive unit shaft) to impellers of the centrifugal compressor stages. For instance, in operation of the centrifugal compressor system 10, rotation of the drive unit shaft is delivered via internal gearing to the various impellers of a first centrifugal compressor stage 26, a second centrifugal compressor stage 28, and a third centrifugal compressor stage 30. In the illustrated embodiment, the internal gearing of the gearbox 24 typically includes a bull gear coupled to a drive shaft that delivers rotational torque to the impeller.

It will be appreciated that such a system (e.g., where a drive unit 14 that is indirectly coupled to the drive shaft that delivers rotational torque to the impeller) is generally referred to as an indirect drive system. In certain embodiments, the indirect drive system may include one or more gears (e.g., gearbox 24), a clutch, a transmission, a belt drive (e.g., belt and pulleys), or any other indirect coupling technique. However, another embodiment of the centrifugal compressor system 10 may include a direct drive system. In an embodiment employing the direct drive system, the gearbox 24 and the drive unit 14 may be essentially integrated into the compressor unit 16 to provide torque directly to the drive shaft. For example, in a direct drive system, a motive device (e.g., an electric motor) surrounds the drive shaft, thereby directly (e.g., without intermediate gearing) imparting a torque on the drive shaft. Accordingly, in an embodiment employing the direct drive system, multiple electric motors can be employed to drive one or more drive shafts and impellers in each stage of the compressor unit 16. However, any type of indirect drive or direct drive system may be used in certain embodiments.

The gearbox 24 includes features that provide for increased reliability and simplified maintenance of the centrifugal compressor system 10. For example, the gearbox 24 may include an integrally cast multi-stage design for enhanced performance. In other words, the gearbox 24 may include a singe casting including all three scrolls helping to reduce the assembly and maintenance concerns typically associated with centrifugal compressor systems 10. Further, the gearbox 24 may include a horizontally split cover for easy removal and inspection of components disposed internal to the gearbox 24.

As discussed briefly above, the compressor unit 16 generally includes one or more centrifugal compression stages that compress the incoming gas in series. For example, in the illustrated embodiment, the compressor unit 16 includes three centrifugal compression stages (e.g., a three-stage centrifugal compressor), including the first centrifugal compressor stage 26, the second centrifugal compressor stage 28, and the third centrifugal compressor stage 30. Each of the centrifugal compressor stages 26, 28, and 30 includes a centrifugal scroll that includes a housing encompassing one or more gas impellers. In operation, incoming gas is sequentially passed into each of the centrifugal compressor stages 26, 28, and 30 before being discharged at an elevated pressure.

Operation of the centrifugal compressor system 10 includes drawing a gas into the first centrifugal compressor stage 26 via a compressor inlet 32 and in the direction of arrow 34. As illustrated, the compressor unit 16 may also include a guide vane 36. The guide vane 36 may include vanes and other mechanisms to direct the flow of the gas as it enters the first centrifugal compressor stage 26. For example, the guide vane 36 may impart a swirling motion to the inlet gas flow in the same direction as the impeller of the first centrifugal compressor stage 26, thereby helping to reduce the work input at the impeller to compress the incoming gas. As described in greater detail below, in certain embodiments, the guide vane 36 may be directly incorporated into each individual centrifugal compressor stage.

After the gas is drawn into the centrifugal compressor system 10 via the compressor inlet 32, the first centrifugal compressor stage 26 compresses and discharges the compressed gas via a first duct 38. The first duct 38 routes the compressed gas into a first stage 40 of the intercooler 18. The compressed gas expelled from the first centrifugal compressor stage 26 is directed through the first stage intercooler 40 and is discharged from the intercooler 18 via a second duct 42.

Generally, each stage of the intercooler 18 includes a heat exchange system to cool the compressed gas. In one embodiment, the intercooler 18 includes a water-in-tube design that effectively removes heat from the compressed gas as it passes over heat exchanging elements internal to the intercooler 18. An intercooler stage is provided after each centrifugal compressor stage to reduce the gas temperature and to improve the efficiency of each subsequent compression stage. For example, in the illustrated embodiment, the second duct 42 routes the compressed gas into the second centrifugal compressor stage 28 and a second stage 44 of the intercooler 18 before routing the gas to the third centrifugal compressor stage 30.

After the third centrifugal compressor stage 30 compresses the gas, the compressed gas is discharged via a compressor discharge 46 in the direction of arrow 47. In the illustrated embodiment, the compressed gas is routed from the third centrifugal compressor stage 30 to the discharge 46 without an intermediate cooling step (e.g., passing through a third intercooler stage). However, other embodiments of the centrifugal compressor system 10 may include a third intercooler stage or similar device configured to cool the compressed gas as it exits the third centrifugal compressor stage 30. Further, additional ducts may be coupled to the discharge 46 to effectively route the compressed gas for use in a desired application (e.g., drying applications).

Figure 2:
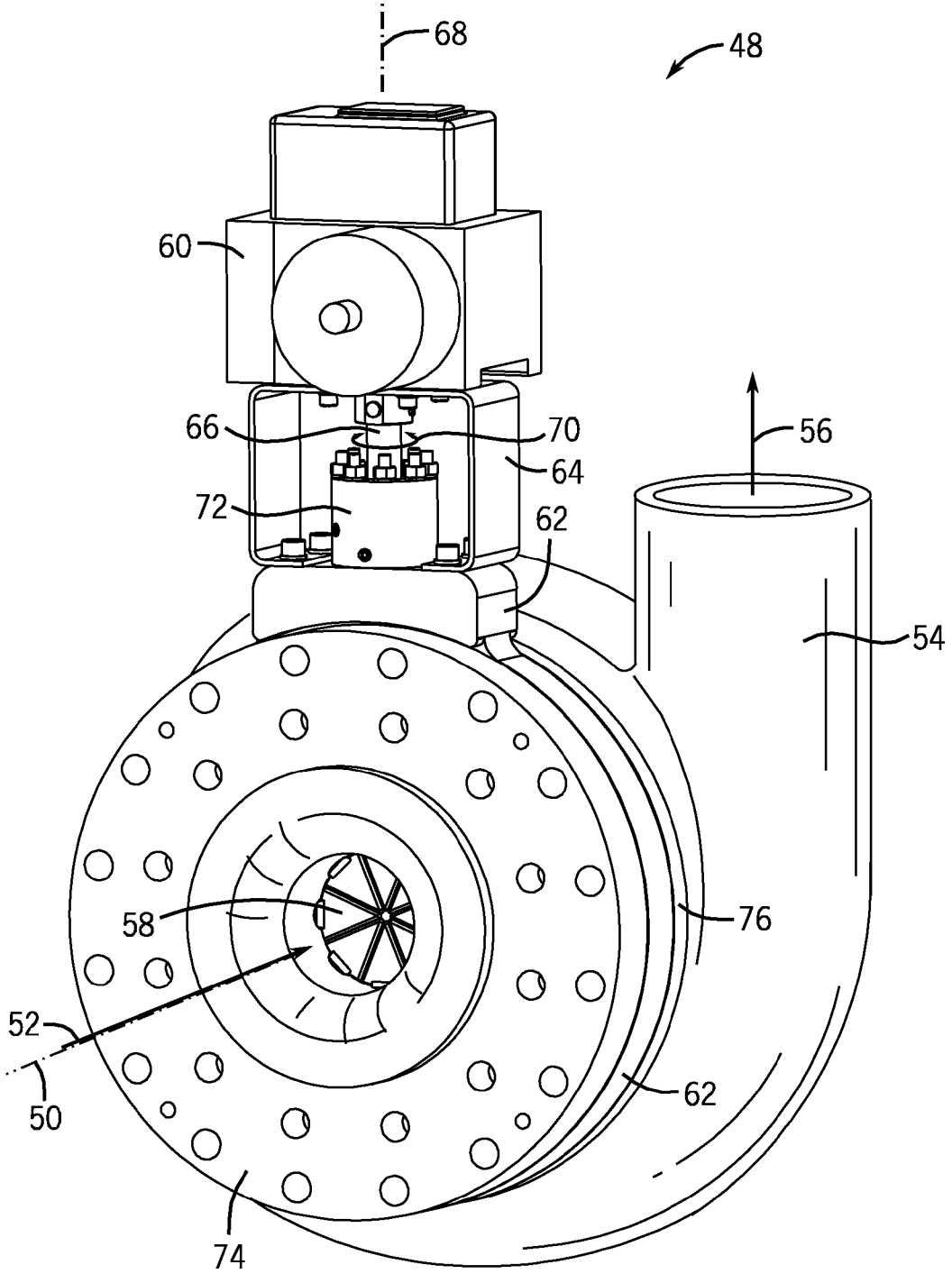
FIG. 2 is a perspective view of an exemplary embodiment of a centrifugal compressor stage of the centrifugal compressor system depicted in FIG. 1.

FIG. 2 is a perspective view of an exemplary embodiment of a centrifugal compressor stage 48, such as the first, second, and third centrifugal compressor stages 26, 28, 30 depicted in FIG. 1. As described above, gas may flow into the centrifugal compressor stage 48 axially along a central axis 50 of the centrifugal compressor stage 48, as illustrated by arrow 52, and may exit the centrifugal compressor stage 48 at an elevated pressure through a scroll casing 54 along a tangential path, as illustrated by arrow 56. As described above, in certain embodiments, the centrifugal compressor stage 48 may include integrated inlet guide vanes 58, unlike the external guide vane 36 depicted in FIG. 1. As illustrated, the inlet guide vanes 58 may be arranged in a radial pattern about the central axis 50 of the centrifugal compressor stage 48. As described in greater detail below, the inlet guide vanes 58 may be rotated in order to vary the gas flow rate into the centrifugal compressor stage 48.

In particular, in certain embodiments, a rotary actuator 60 may be mounted to a spacer ring 62 of the centrifugal compressor stage 48 by an actuator mounting bracket 64. The rotary actuator 60 may be configured to rotate a drive shaft 66 back and forth about its axis 68, as illustrated by arrow 70. Thus, the rotary actuator 60 may rely solely on rotation rather than linear movement to adjust the inlet guide vanes 58. In certain embodiments, the rotary actuator 60 may be a quarter-turn rotary actuator. However, in other embodiments, the rotary actuator 60 may be a half-turn or ¾-turn rotary actuator. As described in greater detail below, rotation of the drive shaft 66 about its axis 68 may affect the orientation of the inlet guide vanes 58 with respect to the central axis 50 of the centrifugal compressor stage 48, thereby adjusting the amount of gas flow into the centrifugal compressor stage 48. For example, each guide vane 58 may rotate about an axis (e.g., radial axis) transverse to the central axis 50 in response to rotation of the drive shaft 66.

The use of a rotary actuator 60 instead of, for instance, a linear actuator may reduce the overall cost of the actuation system, as well as reducing the need for more complicated, pressure-balanced linear drive systems. In addition, actuating the inlet guide vanes 58 by rotating the drive shaft 66 about its axis 68 as opposed to translating the drive shaft 66 axially along its axis 68 may reduce the need for more complicated sealing devices, which may be necessary due to axial motion of the drive shaft 66 into and out of the body of the centrifugal compressor stage 48.

In addition, in certain embodiments, the centrifugal compressor stage 48 may include a pneumatic cylinder 72 between the rotary actuator 60 and the spacer ring 62. The pneumatic cylinder 72 surrounds the drive shaft 66 and, as described in greater detail below, may minimize leakage of the gas being compressed within the centrifugal compressor stage 48. For example, the pneumatic cylinder 72 may include a series of seals (e.g., O-rings) and intermediate ports, which may be used to vent and purge gas (e.g., corrosive gas) from between the seals. Other components of the centrifugal compressor stage 48 illustrated in FIG. 2 include an outer housing 74 and an inlet shroud 76.

Figure 3:
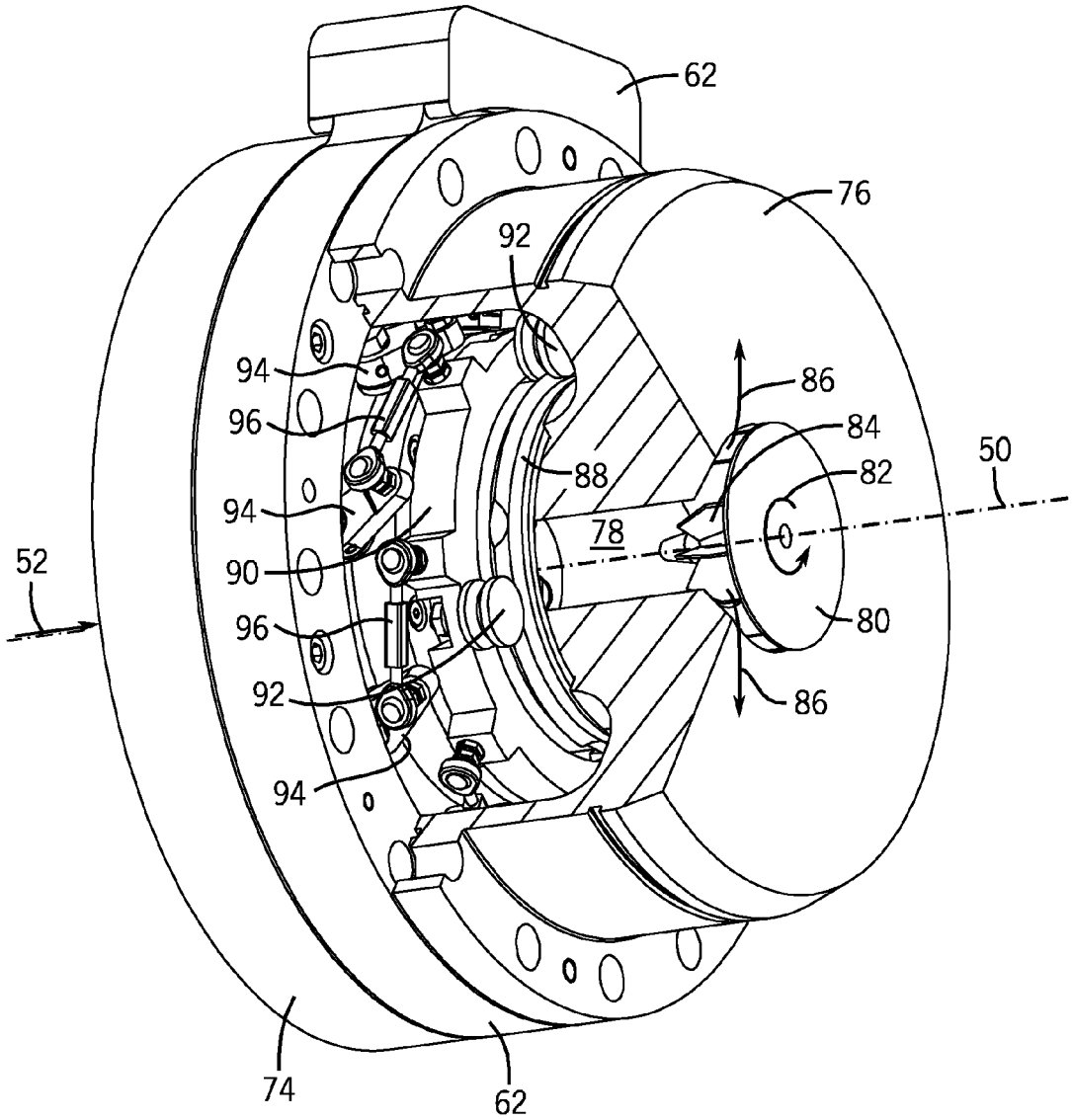
FIG. 3 is a partial cutaway view of exemplary embodiments of an outer housing, a spacer ring, and an inlet shroud of the centrifugal compressor stage.

FIG. 3 is a partial cutaway view of exemplary embodiments of the outer housing 74, spacer ring 62, and inlet shroud 76 of the centrifugal compressor stage 48, further illustrating the flow of gas through the centrifugal compressor stage 48. As described above, the gas may enter the centrifugal compressor stage 48 along the central axis 50, as illustrated by arrow 52. The inlet guide vanes 58 may vary the rate of gas flow into a central cavity 78 within the inlet shroud 76 of the centrifugal compressor stage 48. As described above with respect to FIG. 1, an impeller 80 may be driven by a drive shaft to cause rotation of the impeller 80 about the central axis 50 of the centrifugal compressor stage 48, as illustrated by arrow 82. Rotation of blades 84 of the impeller 80 cause compression of the gas within the central cavity 78 of the inlet shroud 76. The compressed gas discharges from the inlet shroud 76 as illustrated by arrows 86 and, as described above, through the scroll casing 54 illustrated in FIG. 2.

As illustrated, in certain embodiments, the centrifugal compressor stage 48 may include an inner housing 88 that, among other things, houses the inlet guide vanes 58. In addition, in certain embodiments, the centrifugal compressor stage 48 may include an actuating ring 90 that, as described in greater detail below, may be used to cause changes in orientation (e.g., rotation) of the inlet guide vanes 58, thereby adjusting the flow rate of gas into the centrifugal compressor stage 48. In certain embodiments, the actuating ring 90 may be configured to rotate around the inner housing 88 with a plurality of cam followers 92 maintaining axial positioning of the actuating ring 90 with respect to the inner housing 88. In particular, as described in greater detail below with respect to FIG. 10, the cam followers 92 may include v-shaped grooves 128, which mate with a v-shaped track 130 extending radially from the inner housing 88. Thus, the cam followers 92 follow a circular path concentric with the axis 50, while blocking axial movement along the axis 50.

As also described in greater detail below, rotation of the actuating ring 90 about the inner housing 88 may cause rotation of a plurality of crank arms 94 via a plurality of linkages 96, which may cause the inlet guide vanes 58 to change orientation (e.g., rotate about radial axes relative to central axis 50). In particular, the crank arms 94 may be pinned to vane shafts, which extend radially through holes defined by the outer and inner housings 74, 88 and connect to respective inlet guide vanes 58. Rotation of the crank arms 94 may cause rotation of the vane shafts and, in turn, the inlet guide vanes 58.

Figure 4:
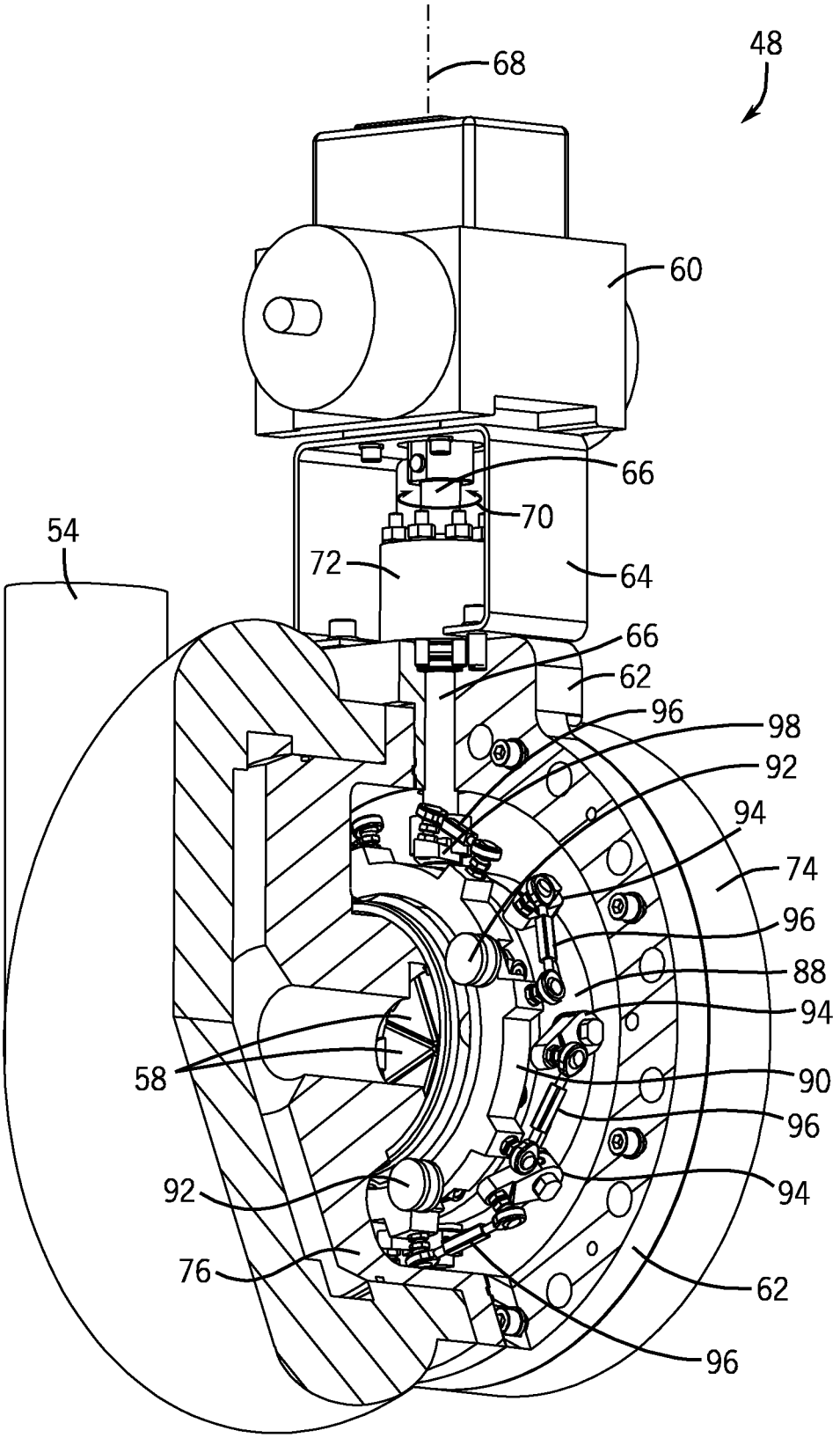
FIG. 4 is a partial cutaway view of an exemplary embodiment of the centrifugal compressor stage, illustrating how the various components fit together.

FIG. 4 is a partial cutaway view of an exemplary embodiment of the centrifugal compressor stage 48, illustrating how the various components fit together. As described above, the drive shaft 66 may be rotated back and forth about its axis 68 by the rotary actuator 60, as illustrated by arrow 70. As described in greater detail below, the drive shaft 66 may be directly connected to a primary vane shaft, which may cause rotation of a primary inlet guide vane 58. A primary crank arm 98 directly connected to the drive shaft 66 may also be caused to rotate by rotation of the drive shaft 66. Rotation of the primary crank arm 98 may cause rotation of the actuating ring 90 about the inner housing 88. In particular, a linkage 96 connected to the primary crank arm 98 may cause the actuating ring 90 to rotate with respect to the inner housing 88 upon rotation of the primary crank arm 98. As the actuating ring 90 rotates relative to the inner housing 88, the other crank arms 94 cause rotation of their respective vane shafts which, in turn, cause rotation of their respective inlet guide vanes 58. As such, rotation of the drive shaft 66 causes direct rotation (e.g., without aid from the crank arms 94 or the linkages 96) of a primary inlet guide vane 58 while, with the help of the actuating ring 90, causing indirect rotation (e.g., with the aid from the crank arms 94 or the linkages 96) of the other inlet guide vanes 58.

Figure 5:
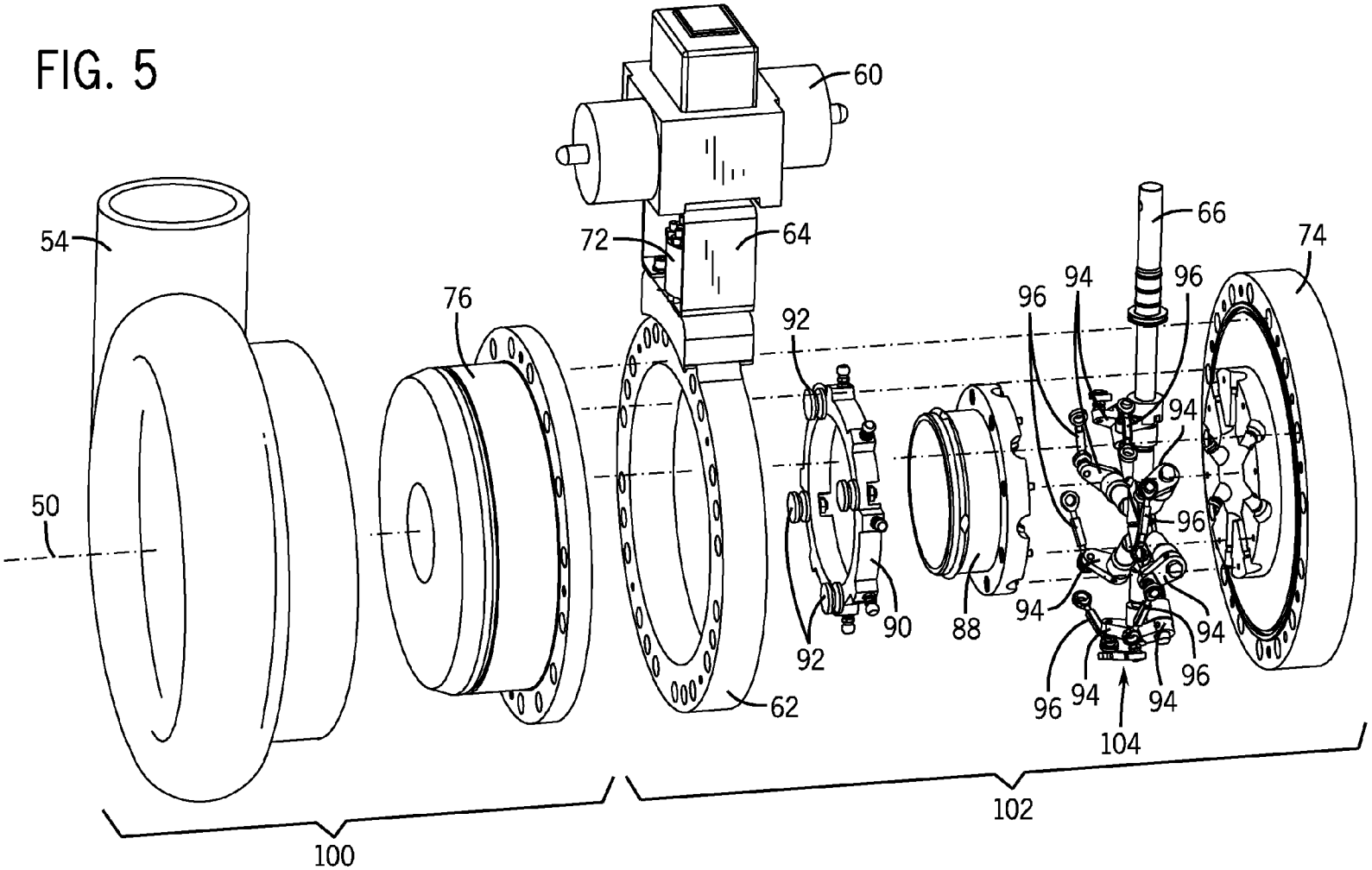
FIG. 5 is an exploded view of an exemplary embodiment of the centrifugal compressor stage, further illustrating how the various components fit together.

FIG. 5 is an exploded view of an exemplary embodiment of the centrifugal compressor stage 48, further illustrating how the various components fit together. As illustrated, the inlet shroud 76 may fit within the scroll casing 54. In particular, in certain embodiments, the inlet shroud 76 may be configured to be bolted or otherwise connected to the scroll casing 54 to form an integrated compressor assembly 100. In addition, in certain embodiments, the remaining components of the centrifugal compressor stage 48 may be configured to connect together to form a separable, integrated inlet guide vane assembly 102. For example, in certain embodiments, cap screws may be used to fix the inner housing 88 to the outer housing 74 and counter-sunk cap screws may be used to fix the spacer ring 62 to the outer housing 74. Moreover, in certain embodiments, the inlet guide vane assembly 102 may be configured to connect to the compressor assembly 100. For example, in certain embodiments, cap screws may extend through the outer housing 74, spacer ring 62, and inlet shroud 76, and into threaded holes in the scroll casing 54. It should be noted that many of the components of what may be referred to as an inlet guide vane actuation assembly 104 (e.g., including the drive shaft 66, crank arms 94, linkages 96, vane shafts, inlet guide vanes 58, and so forth) will be described in greater detail below with respect to FIGS. 8 through 10. All of the components illustrated in FIG. 5 as being part of the inlet guide vane assembly 102 may be removable from both the compressor assembly 100 as well as from other components of the inlet guide vane assembly 102.

Figure 6A:
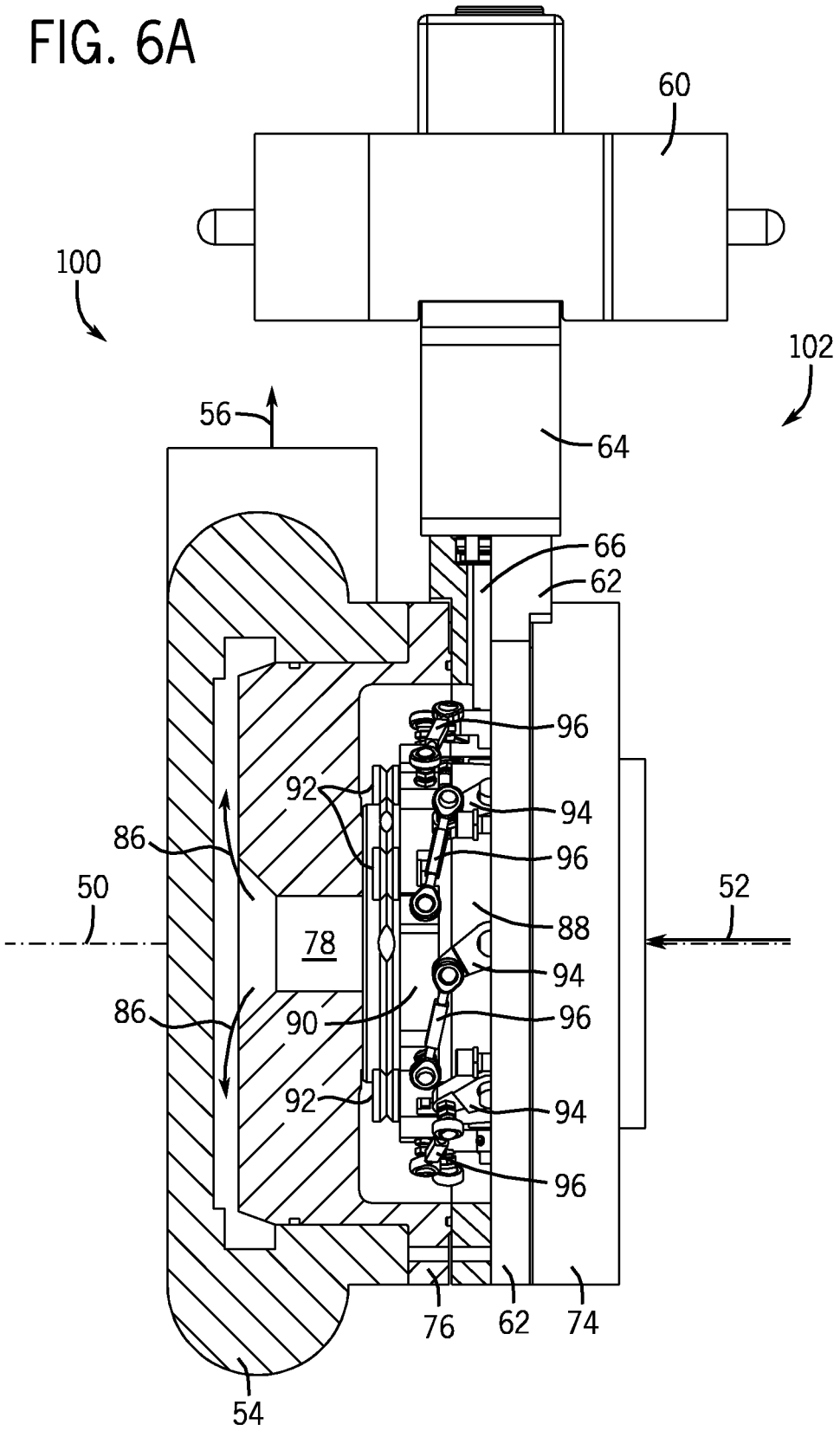
FIGS. 6A and 6B are partial cross-sectional views of exemplary embodiments of a scroll casing, the inlet shroud, and an inlet guide vane assembly of the centrifugal compressor stage.
Figure 6B:
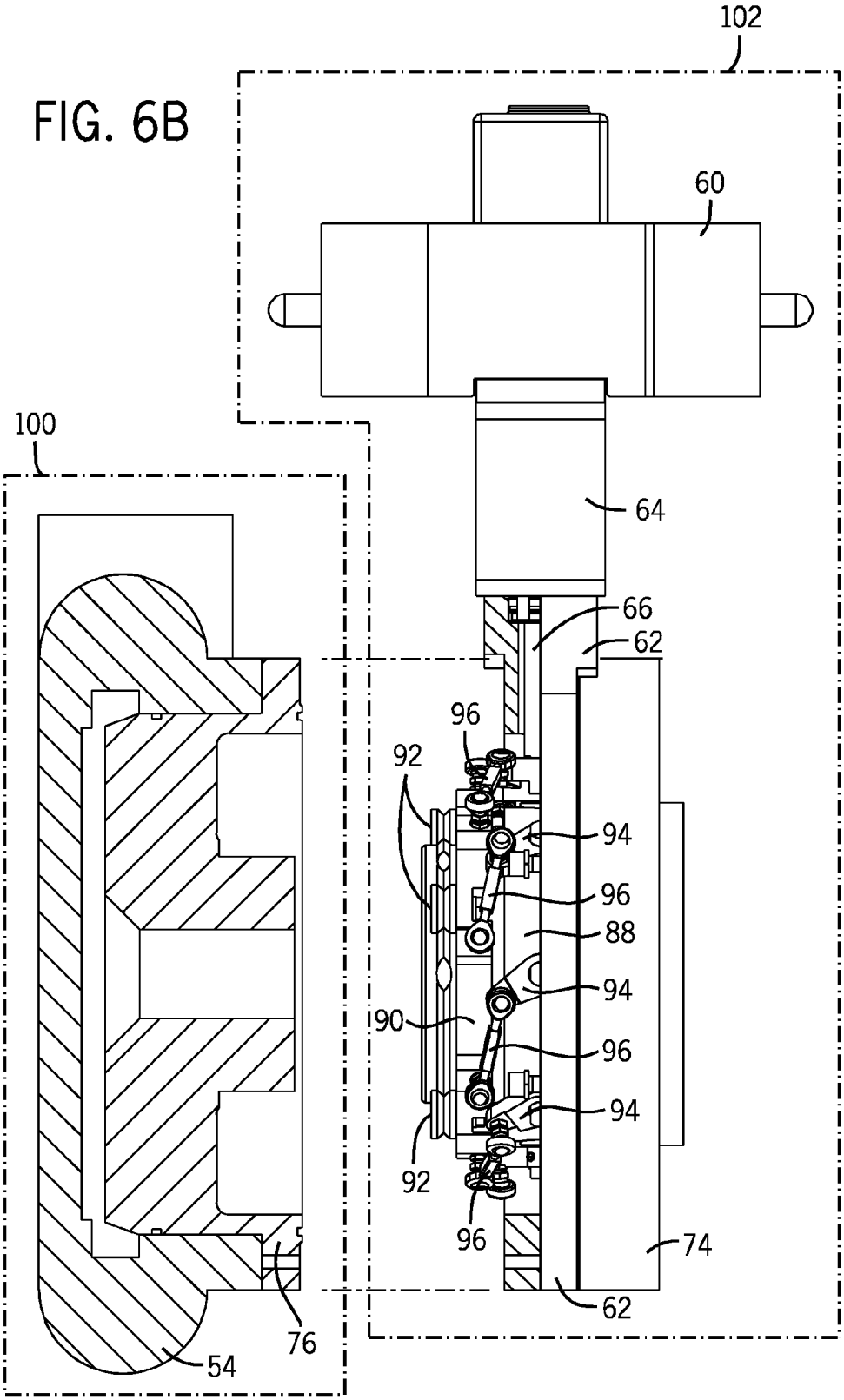

FIGS. 6A and 6B are partial cross-sectional views of exemplary embodiments of the scroll casing 54, inlet shroud 76, and inlet guide vane assembly 102 of the centrifugal compressor stage 48. As illustrated in FIG. 6A, gas may flow into the inlet guide vane assembly 102 along the central axis 50 as illustrated by arrow 52, enter the central cavity 78 within the inner shroud 76, be compressed by the impeller 80, discharge into the scroll casing 54 as illustrated by arrows 86, and ultimately exit the scroll casing 54 as illustrated by arrow 56.

However, FIG. 6A illustrates the separable inlet guide vane assembly 102 connected to the inlet shroud 76 and scroll casing 54. In contrast, FIG. 6B illustrates the inlet guide vane assembly 102 separated from both the inlet shroud 76 and the scroll casing 54 (e.g., the compressor assembly 100). Indeed, the ability to remove the inlet guide vane assembly 102 from the inlet shroud 76 and scroll casing 54 is one of the benefits of the present embodiments. In particular, the inlet guide vane assembly 102 may be mounted within a throat of the inlet shroud 76 while still enabling easy removal of the inlet guide vane assembly 102. This enables increased maintenance flexibility of the inlet guide vane assembly 102 and its associated components while also enabling operation of the centrifugal compressor stage 48 at higher pressures. In addition, by enclosing the actuating ring 90, inner housing 88, and inlet guide vane actuation assembly 104 within the existing compressor assembly 100, the inlet guide vane assembly 102 may, in general, be much smaller and lighter weight than conventional guide vane assemblies, such as the external guide vane 36 illustrated in FIG. 1, while still being capable of withstanding higher operating pressures. In other words, the actuating ring 90, inner housing 88, and inlet guide vane actuation assembly 104 are dependent on the compressor assembly 100 as an enclosure, rather than using a separate enclosure independent from the assembly 100. Thus, rather than being self contained, the inlet guide vane assembly 102 becomes enclosed upon assembly with the compressor assembly 100.

Figure 7A:
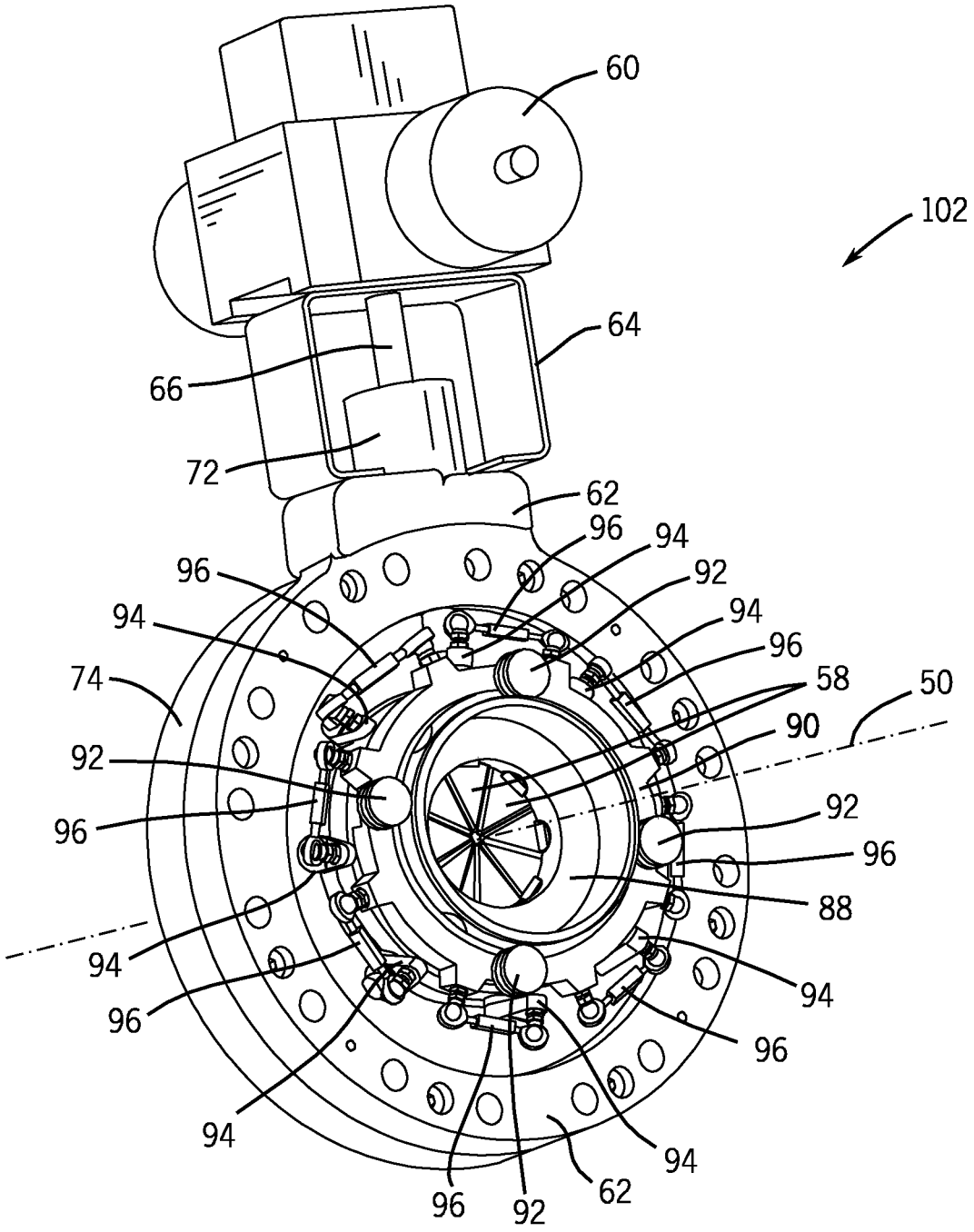
FIGS. 7A and 7B are perspective views of exemplary embodiments of the inlet guide vane assembly, illustrating inlet guide vanes in a partially open orientation and a closed orientation, respectively.
Figure 7B:
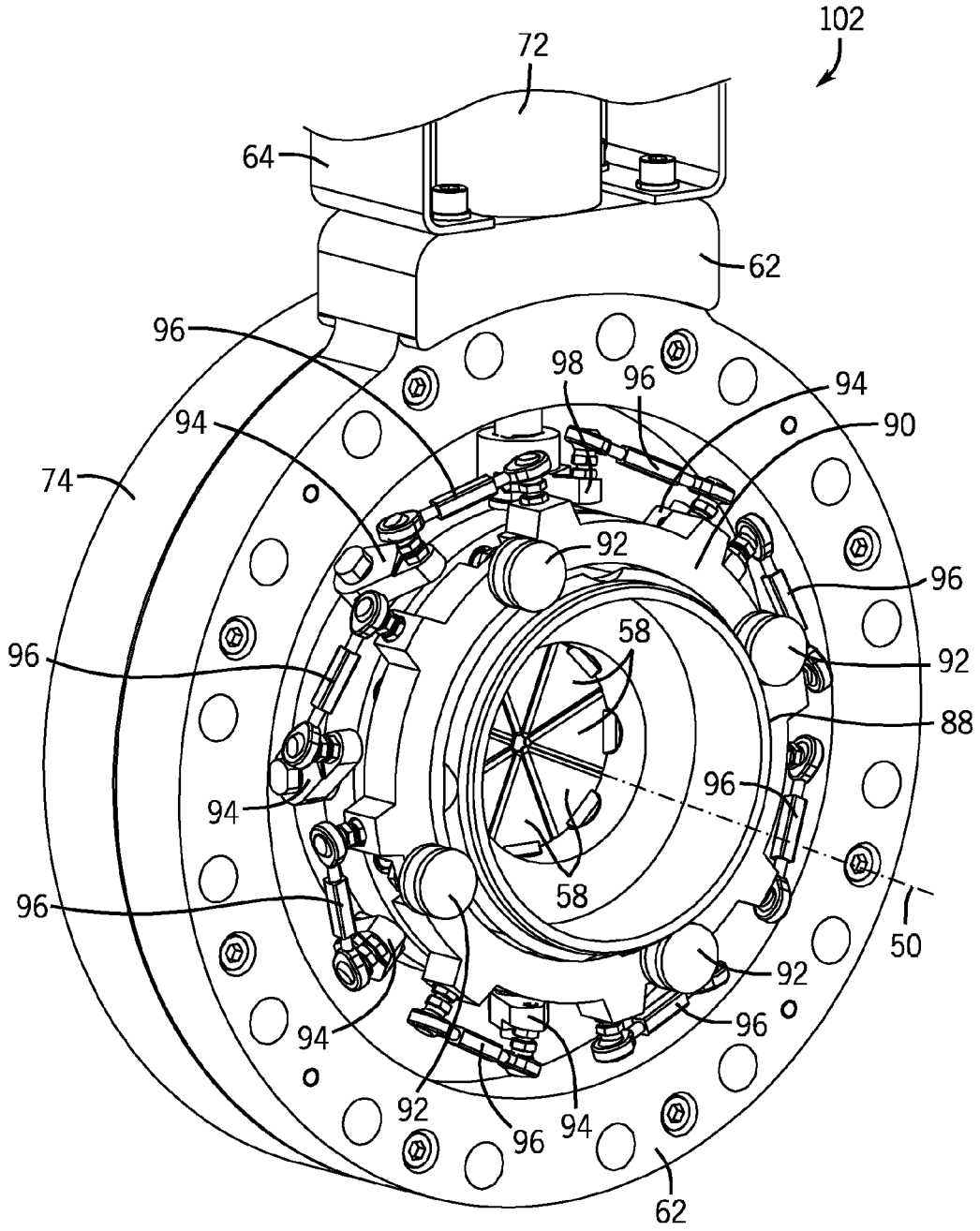

FIGS. 7A and 7B are perspective views of exemplary embodiments of the inlet guide vane assembly 102, illustrating the inlet guide vanes 58 in a partially open orientation and a closed orientation, respectively. In particular, FIG. 7A illustrates the inlet guide vanes 58 in a partially open orientation. In other words, the inlet guide vanes 58 are oriented at an angle with respect to a plane orthogonal to the central axis 50. In contrast, FIG. 7B illustrates the inlet guide vanes 58 in a closed orientation. In other words, the inlet guide vanes 58 are oriented along a plane orthogonal to the central axis 50. It should be noted that the actuator ring 90 is not illustrated in FIG. 7B to aid illustration of the inlet guide vanes 58 in the closed orientation. In the embodiments illustrated in FIGS. 7A and 7B, eight triangular-shaped inlet guide vanes 58 are used. However, in other embodiments, other numbers (e.g., four, six, ten, twelve, and so forth) of inlet guide vanes 58 may be used. Also, as discussed above, the inlet guide vanes 58 are an integral part of the separable inlet guide vane assembly 102, which may be directly connected and disconnected from the throat of the compressor stage (e.g., the compressor assembly 100). This is, for example, different than the external guide vane 36 illustrated in FIG. 1 above, as well as being different from guide vanes which are directly integrated into the compressor assembly 100.

Figure 8:
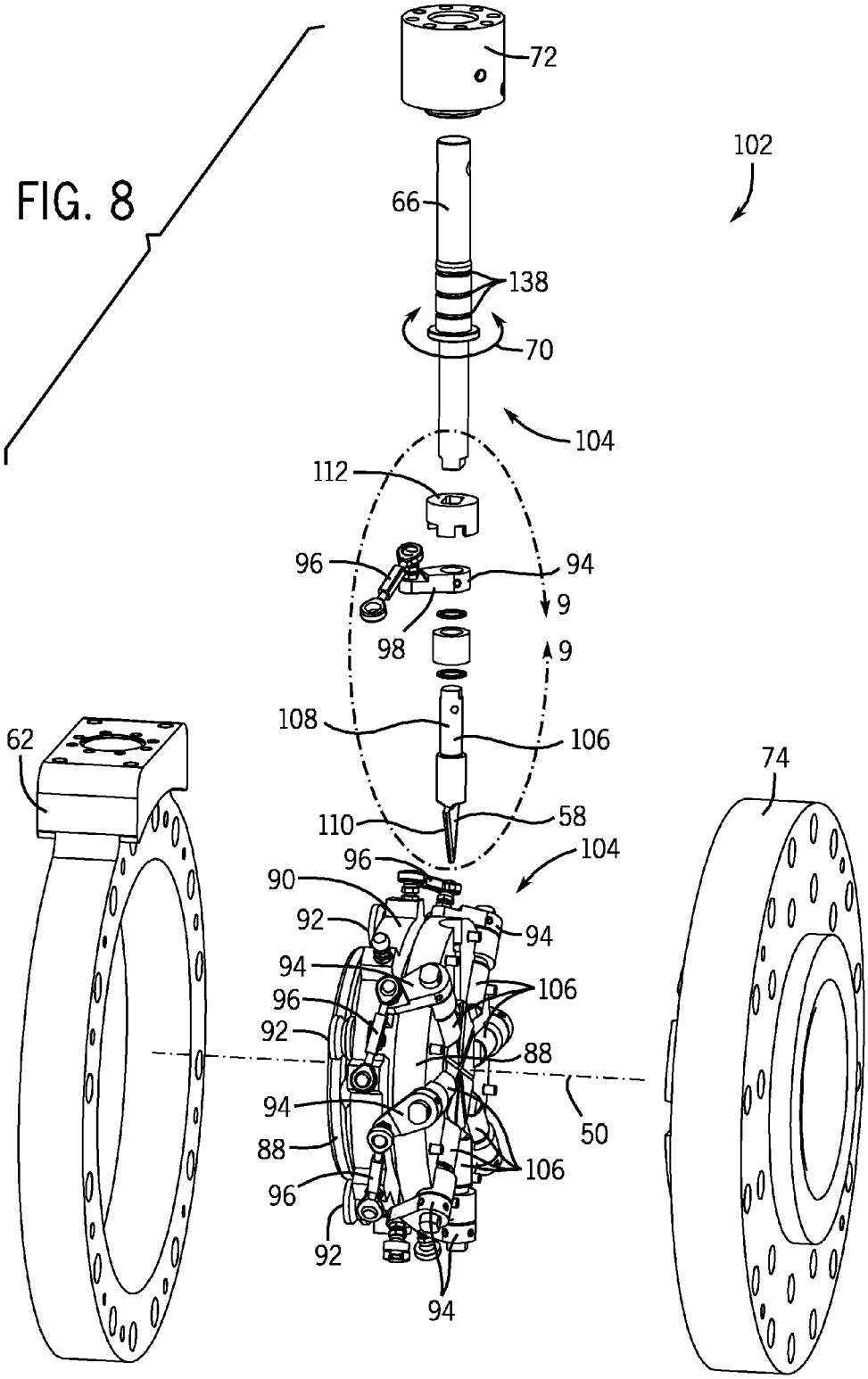
FIG. 8 is an exploded view of an exemplary embodiment of the inlet guide vane assembly.

FIG. 8 is an exploded view of an exemplary embodiment of the inlet guide vane assembly 102. In addition, FIG. 8 depicts the main components of the inlet guide vane actuation assembly 104. As described above, the inlet guide vane actuation assembly 104 may include the drive shaft 66, crank arms 94, linkages 96, and inlet guide vanes 58. In addition, the inlet guide vane actuation assembly 104 may include the vane shafts 106 mentioned above, including a primary vane shaft 108. As illustrated, each vane shaft 106 may have an inlet guide vane 58 attached to an end of the vane shaft 106. As described above, rotation of the drive shaft 66 about its axis 68, as illustrated by arrow 70, may directly cause rotation of the primary vane shaft 108, thereby adjusting the orientation of a primary guide vane 110. In other words, the drive shaft 66 and the primary vane shaft 108 (and the primary inlet guide vane 110) rotate along a common rotational axis 68 directly in line with each other.

As also described above, rotation of the drive shaft 66 about its axis 68 may indirectly cause rotation of the other (secondary) vane shafts 106 by causing the actuating ring 90 to rotate relative to the inner housing 88. In particular, rotation of the drive shaft 66 may also cause rotation of the primary crank arm 98. Rotation of the primary crank arm 98 may then be transferred to the actuating ring 90 via an associated linkage 96. The other linkages 96 attached to the actuating ring 90 may cause rotation of their respective crank arms 94 which, in turn, cause rotation of their respective vane shafts 106, thereby causing rotation of the other (secondary) inlet guide vanes 58. As such, the orientation of all the inlet guide vanes 58 may be substantially synchronized. It should be noted that, unlike with the primary vane shaft 108, the drive shaft 66 and the secondary vane shafts 106 (and secondary inlet guide vanes 58) do not rotate along a common rotational axis directly in line with each other.

Figure 9:
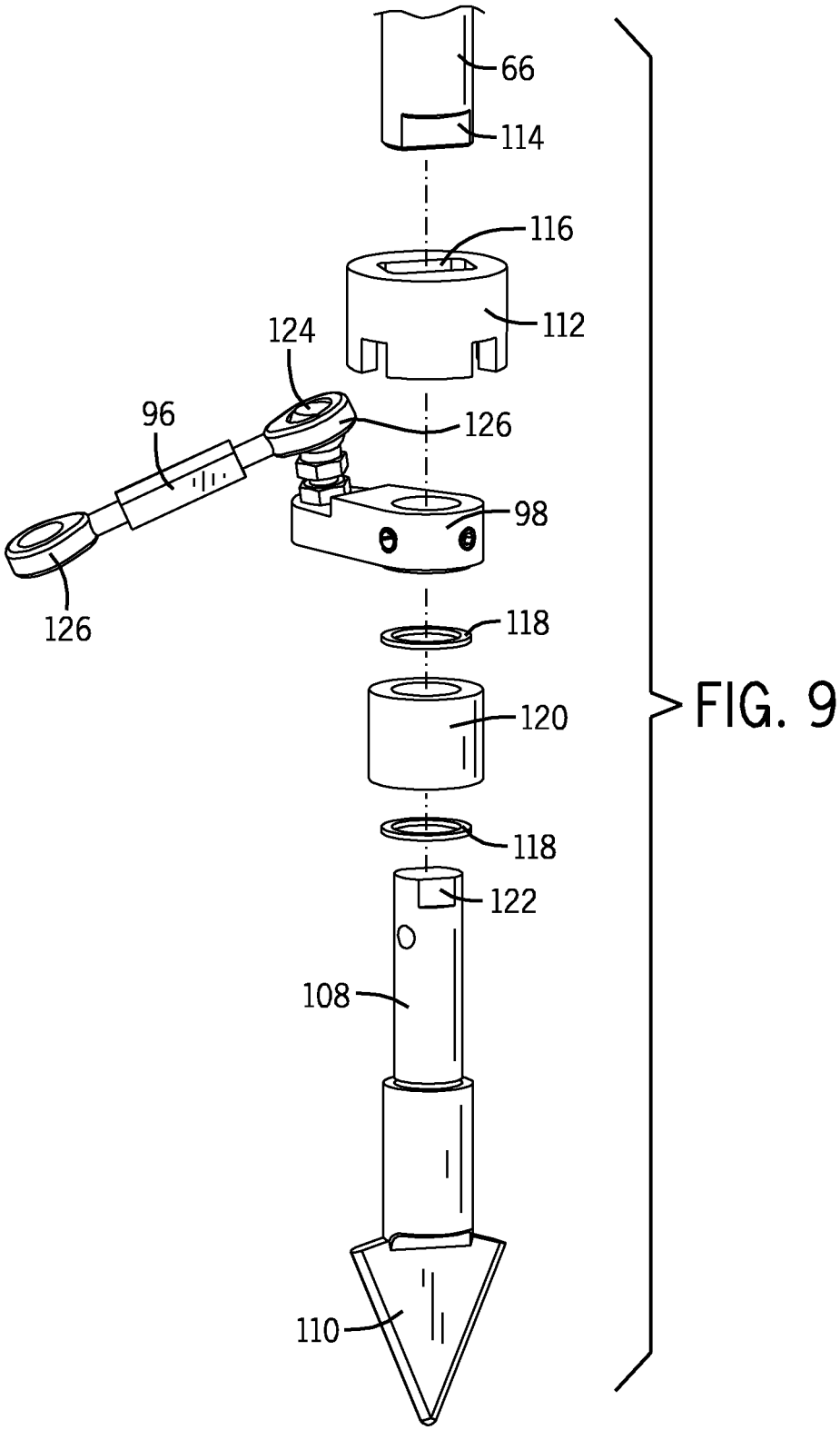
FIG. 9 is an exploded view of certain components of an exemplary embodiment of an inlet guide vane actuation assembly.

FIG. 9 is an exploded view of certain components of an exemplary embodiment of the inlet guide vane actuation assembly 104. In particular, the drive shaft 66 may be directly connected to a coupling adapter 112. In the illustrated embodiment, the drive shaft 66 may include a notched end 114 configured to mate with a notched opening 116 in the coupling adapter 112, such that torque from the drive shaft 66 may be transferred to the coupling adapter 112. The coupling adapter 112 may, in turn, be configured to fit over the primary crank arm 98 to couple the primary crank arm 98 to the drive shaft 66. In certain embodiments, a pair of anti-friction thrust washers 118 and an anti-friction bushing 120 may be located between the crank arms 94, such as the primary crank arm 98, and the vane shafts 106 (e.g., primary vane shaft 108). The vane shafts 106 (e.g., primary vane shaft 108) may also include a notched end 122 configured to mate with the crank arms 94 (e.g., primary crank arm 98).

Figure 10:
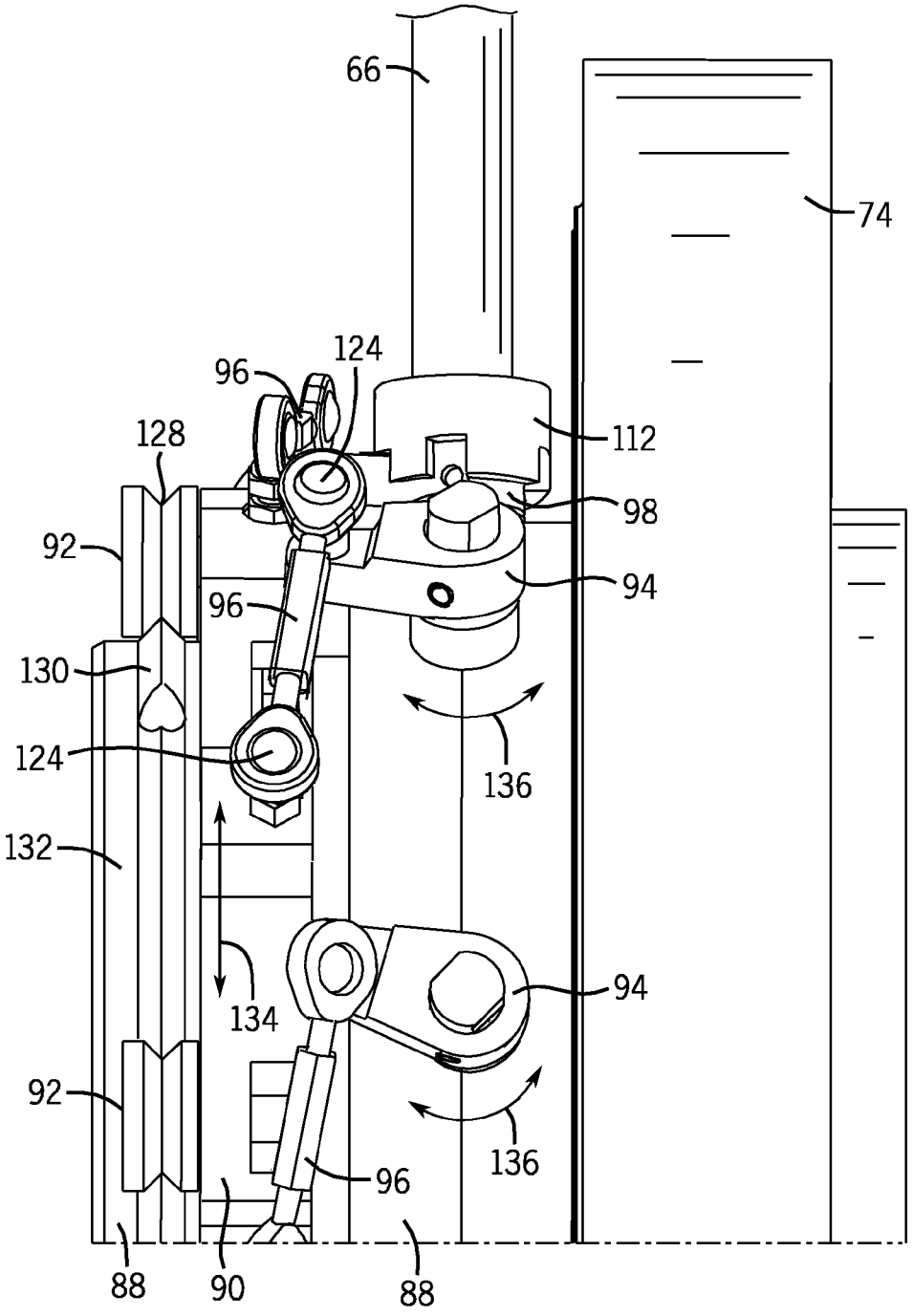
FIG. 10 is a partial side view of the inlet guide vane assembly.

As described above, rotation of the drive shaft 66 may directly cause rotation of the primary vane shaft 108 and, as such, may directly adjust the angular orientation of the primary inlet guide vane 110. In addition, rotation of the drive shaft 66 may cause rotation of the primary crank arm 98, which in turn may indirectly cause rotation of the other vane shafts 106 through the actuating ring 90. As such, rotation of the drive shaft 66 may indirectly adjust the orientation of the other inlet guide vanes 58. In particular, as described above, rotation of the primary crank arm 98 may be transferred to the actuating ring 90 through the linkage 96 attached to the primary crank arm 98. As illustrated in FIG. 9, the linkages 96 may be attached to the crank arms 94, such as the primary crank arm 98, via spherical bearings 124 attached to an end of each crank arm 94. As illustrated in FIG. 10, the actuating ring 90 may also include spherical bearings 124 to which the linkages 96 may connect. In particular, the linkages 96 may include two circular openings 126 (e.g., eye-shaped holes) at both ends of the linkages 96 within which the spherical bearings 124 may fit. The use of spherical bearing linkages 96 may enable the rotation of the crank arms 94 to be transferred to and from the actuating ring 90 such that the rotational alignment of the actuating ring 90 relative to the inner housing 88 may be facilitated with minimal axial displacement of the actuating ring 90 relative to the inner housing 88.

As described above, the cam followers 92 attached to the actuating ring 90 may further aid axial alignment of the actuating ring 90 relative to the inner housing 88. FIG. 10 is a partial side view of the inlet guide vane assembly 102. As illustrated in FIG. 10, the cam followers 92 may include v-shaped grooves 128, which mate with a v-shaped track 130 on an external face 132 of the inner housing 88. In particular, the v-shaped track 130 is a circular track disposed about a circumference of the external face 132 of the inner housing 88. Thus, the cam followers 92 are guided along the circular track via the interface between the v-shaped grooves 128 and v-shaped track 130. As the actuating ring 90 rotates relative to the inner housing 88, as illustrated by arrow 134, the cam followers 92 ride along the v-shaped track 130, minimizing axial movement of the actuating ring 90 relative to the inner housing 88.

As described above, as the actuating ring 90 rotates relative to the inner housing 88, as illustrated by arrow 134, the crank arms 94 may be caused to rotate by the linkages 96, as illustrated by arrows 136. Since the crank arms 94 are connected to the vane shafts 106, rotation of the crank arms 94 causes rotation of the vane shafts 106, thereby leading to rotation of the inlet guide vanes 58 at the end of each respective vane shaft 106.

Figure 11:
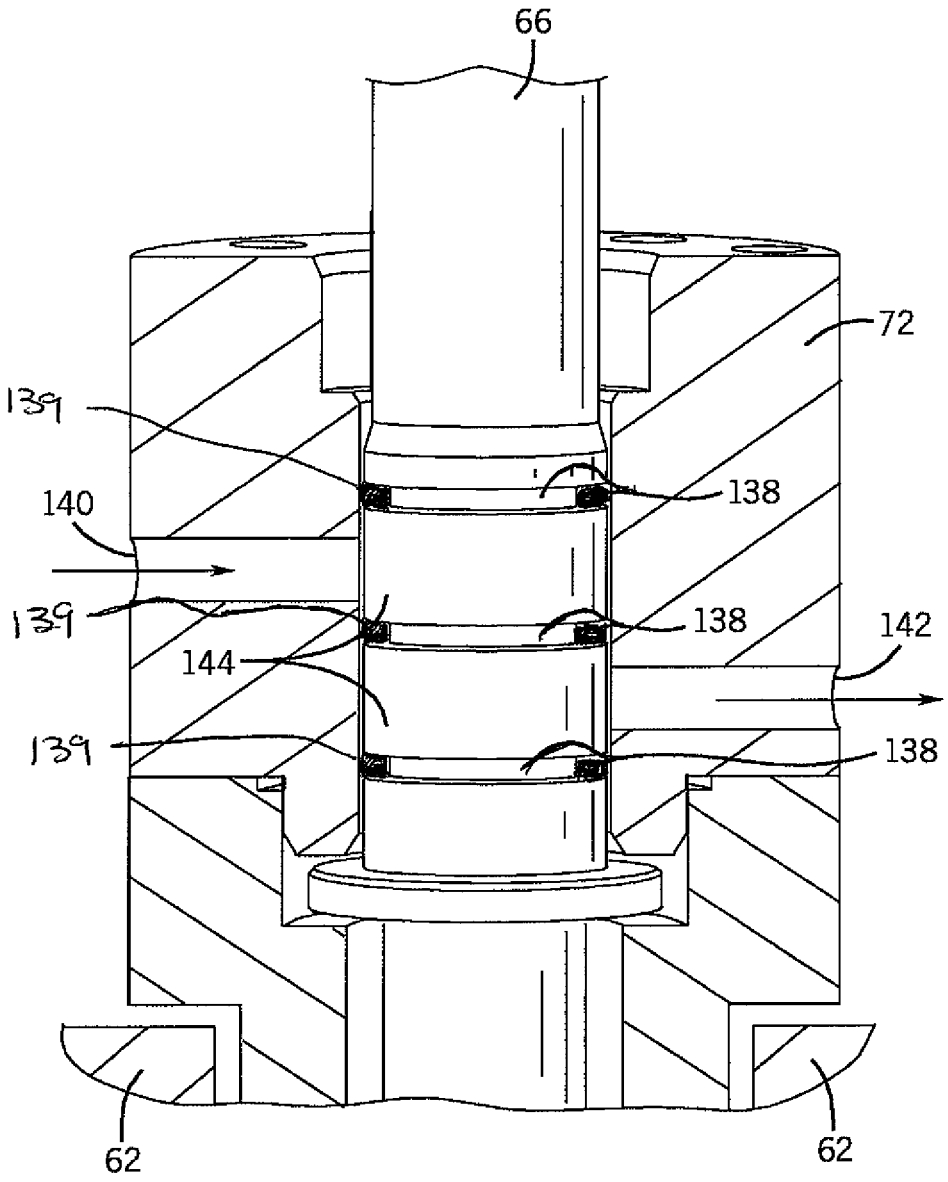
FIG. 11 is a partial cross-sectional view of an exemplary embodiment of a drive shaft, the spacer ring, and a pneumatic cylinder of the inlet guide vane assembly.

As described above, the pneumatic cylinder 72 may provide leakage protection such that compressed gas leaking along the drive shaft 66 is minimized. FIG. 11 is a partial cross-sectional view of an exemplary embodiment of the drive shaft 66, spacer ring 62, and pneumatic cylinder 72. As illustrated, in certain embodiments, the drive shaft 66 may include a plurality of grooves 138 (e.g., annular grooves) extending around the drive shaft 66 within which seals 139, such as glide ring seals (e.g., annular seals), may be used to block a certain amount of gas leakage along the drive shaft 66. The illustrated embodiment includes three grooves 138, however, other embodiments may include different numbers of grooves 138 (e.g., one, two, four, or five grooves).

In addition, the pneumatic cylinder 72 may also include an inlet buffer port 140 and an outlet buffer port 142. In certain embodiments, a buffer gas (e.g., air or other non-corrosive gas) may be injected into the inlet buffer port 140 at elevated pressures such that the pressure of the process gas leaking along the drive shaft 66 may be overcome. Doing so may cause the process gas leaking along the drive shaft 66 to be expelled through the outlet buffer port 142 as opposed to leaking further along the drive shaft 66. As illustrated, both the inlet and outlet buffer ports 140, 142 may generally be located within sealed regions 144 along the drive shaft 66. In other words, the inlet and outlet buffer ports 140, 142 may generally be located along the drive shaft 66 between pairs of grooves 138 and associated seals.

The disclosed embodiments provide several benefits. For example, utilizing the inlet guide vane assembly 102 in close proximity to the compressor assembly 100 (e.g., mounted in the throat of the compressor assembly 100), as opposed to externally such as the guide vane 36 illustrated in FIG. 1, the space occupied by each individual centrifugal compressor stage 48 may be minimized. In addition, the need for external supports may also be reduced. However, the use of a separable inlet guide vane assembly 102 may facilitate maintenance by enabling easy removal of the inlet guide vane assembly 102 and its components from the compressor assembly 100. In addition, actuating the inlet guide vanes 58 by rotating the drive shaft 66 radially, as opposed to displacing the drive shaft 66 axially, reduces the need for expensive and complicated sealing techniques. Rather, the pneumatic cylinder 72 described herein may provide sufficient sealing and venting capability by injecting a high-pressure buffer gas through the inlet buffer port 140 and expelling the buffer gas, as well as the process gas leaking along the drive shaft 66, through the outlet buffer port 142. Also, the use of the cam followers 92 to ensure minimal axial displacement between the actuating ring 90 and the inner housing 88 may prove beneficial.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system for gas compression, comprising:

an inlet guide vane assembly, comprising:

a plurality of inlet guide vanes disposed in a radial pattern around a central axis and configured to rotate about axes crosswise to the central axis;

an inner housing disposed around the central axis and surrounding the plurality of inlet guide vanes;

an actuating ring disposed around the inner housing;

a plurality of vane shafts, wherein each vane shaft of the plurality of vane shafts is coupled to a respective inlet guide vane of the plurality of inlet guide vanes and is configured to rotate with the respective inlet guide vane about the respective axis;

a plurality of crank arms, wherein each crank arm of the plurality of crank arms is connected to a respective vane shaft of the plurality of vane shafts and each crank arm is further connected to the actuating ring, and each crank arm of the plurality of crank arms is configured to rotate with its respective vane shaft of the plurality of vane shafts;

a drive shaft coupled to a primary inlet guide vane of the plurality of inlet guide vanes, wherein the drive shaft is coupled to the actuating ring with a primary crank arm of the plurality of crank arms, wherein a rotation of the drive shaft rotates the primary inlet guide vane along a common rotational axis, and the rotation of the drive shaft rotates the actuating ring via the primary crank arm which causes secondary inlet guide vanes of the plurality of inlet guide vanes to rotate about their respective axes offset from the common rotational axis;

a rotary actuator coupled to the drive shaft and configured to cause rotation of the drive shaft; and a plurality of linkages, wherein each linkage of the plurality of linkages is connected to a respective crank arm of the plurality of crank arms and is connected to the actuating ring, wherein each linkage of the plurality of linkages comprise a pair of eye-shaped holes configured to mate with spherical bearings on the plurality of cranks arms and the actuating ring.

2. The system of claim 1, comprising a compressor assembly connected to the inlet guide vane assembly, wherein the compressor assembly comprises an inlet shroud and a scroll casing.

3. The system of claim 1, wherein the inlet guide vane assembly comprises a pneumatic cylinder disposed around the drive shaft, wherein the pneumatic cylinder comprises an inlet buffer port configured to receive a buffer gas and an outlet buffer port configured to expel the buffer gas and a process gas leaking along the drive shaft.

4. The system of claim 1, wherein the inlet guide vane assembly comprises a plurality of seals, and each seal of the plurality of seals is disposed within a respective groove of a plurality of grooves of the drive shaft.

5. The system of claim 1, wherein the rotary actuator is directly coupled to the drive shaft.

6. The system of claim 1, wherein the rotary actuator is coaxial with the drive shaft.

7. A system for gas compression, comprising:

an inlet guide vane assembly, comprising:

a plurality of inlet guide vanes disposed in a radial pattern around a central axis and configured to rotate about axes crosswise to the central axis;

a drive shaft coupled to a primary inlet guide vane of the plurality of inlet guide vanes and one or more structural members coupling the drive shaft to secondary guide vanes of the plurality of guide vanes, wherein a rotation of the drive shaft rotates the primary inlet guide vane along a common rotational axis, and the rotation of the drive shaft causes secondary inlet guide vanes of the plurality of inlet guide vanes to rotate about their respective axes offset from the common rotational axis;

a pneumatic cylinder disposed around the drive shaft, wherein the pneumatic cylinder comprises an inlet buffer port configured to receive a buffer gas and an outlet buffer port configured to expel the buffer gas and a process gas leaking along the drive shaft; and a rotary actuator coupled to the drive shaft and configured to cause rotation of the drive shaft, wherein the drive shaft comprises a plurality of grooves extending circumferentially around the drive shaft, and wherein the inlet and outlet buffer ports of the pneumatic cylinder are positioned axially between adjacent grooves of the plurality of grooves.

8. The system of claim 7, wherein the inlet guide vane assembly comprises a plurality of seals, and each seal of the plurality of seals is disposed within a respective groove of the plurality of grooves of the drive shaft.

9. The system of claim 7, comprising a plurality of vane shafts, wherein each vane shaft of the plurality of vane shafts is coupled to a respective inlet guide vane of the plurality of inlet guide vanes and is configured to rotate with the respective inlet guide vane about the respective axis.

10. The system of claim 9, wherein the inlet guide vane assembly comprises a plurality of crank arms, wherein each crank arm of the plurality of crank arms is connected to a respective vane shaft of the plurality of vane shafts, and each crank arm of the plurality of crank arms is configured to rotate with its respective vane shaft of the plurality of vane shafts.

11. The system of claim 10, wherein the inlet guide vane assembly comprises:

an inner housing disposed around the central axis and surrounding the plurality of inlet guide vanes;

an actuating ring disposed around the inner housing; and a plurality of linkages, wherein each linkage of the plurality of linkages is connected to a respective crank arm of the plurality of crank arms and is connected to the actuating ring.

12. The system of claim 11, wherein the plurality of linkages is configured to cause rotation of the actuating ring relative to the inner housing upon rotation of the drive shaft.

13. The system of claim 7, wherein the inlet guide vane assembly comprises a plurality of cam followers and a plurality of members coupled to an actuating ring, wherein the plurality of members are coupled to a plurality of vane shafts, wherein each vane shaft of the plurality of vane shafts is coupled to a respective inlet guide vane of the plurality of inlet guide vanes.

14. A system for gas compression, comprising:

an inlet guide vane assembly, comprising:

a plurality of inlet guide vanes disposed in a radial pattern around a central axis and configured to rotate about axes crosswise to the central axis;

an inner housing disposed around the central axis and surrounding the plurality of inlet guide vanes;

an actuating ring disposed around the inner housing;

a drive shaft coupled to a primary inlet guide vane of the plurality of inlet guide vanes and to the actuating ring, wherein a rotation of the drive shaft rotates the primary inlet guide vane along a common rotational axis, and the rotation of the drive shaft rotates the actuating ring and causes secondary inlet guide vanes of the plurality of inlet guide vanes to rotate about their respective axes offset from the common rotational axis; and a rotary actuator coupled to the drive shaft and configured to cause rotation of the drive shaft, wherein the inlet guide vane assembly comprises a plurality of cam followers coupled to the actuating ring, and each cam follower of the plurality of cam followers comprises a v-shaped groove configured to mate with a v-shaped track extending circumferentially around an exterior face of the inner housing.

* * * * *